US007108144B2

(12) United States Patent
Goodwin

(10) Patent No.: US 7,108,144 B2
(45) **Date of Patent: *Sep. 19, 2006**

(54) PORTABLE WORK STATIONS

(76) Inventor: Brad Arnold Goodwin, 2737 Fowler Rd., Harrisville, MI (US) 48740

( * ) Notice: Subject to any disclaimer, the term of this patent is extended or adjusted under 35 U.S.C. 154(b) by 0 days.

This patent is subject to a terminal disclaimer.

(21) Appl. No.: 11/036,819

(22) Filed: Jan. 14, 2005

(65) Prior Publication Data

US 2005/0126658 A1 Jun. 16, 2005

Related U.S. Application Data

(63) Continuation-in-part of application No. 10/719,492, filed on Nov. 21, 2003.

(60) Provisional application No. 60/537,106, filed on Jan. 16, 2004.

(51) Int. Cl.
*A47B 47/00* (2006.01)

(52) U.S. Cl. ..... 211/189; 118/500; 248/188.6; 269/905

(58) Field of Classification Search ..... 211/201, 211/189, 182, 204, 47, 8, 150, 186, 169, 165, 211/119.08; 248/184.1, 172, 370, 371, 125.9, 248/130, 125.8, 201, 188.6, 176.1; 144/286.5, 144/287; 108/6, 33, 137, 138, 139, 28; 118/500, 118/502, 503; 269/905, 37; 29/281.1
See application file for complete search history.

(56) References Cited

U.S. PATENT DOCUMENTS 247,730 A * 9/1881 Haas et al. ..... 27/27
250,997 A * 12/1881 Stoetzel ..... 27/27
258,558 A * 5/1882 Cook ..... 118/500
383,368 A * 5/1888 Patterson ..... 414/783
413,679 A * 10/1889 Obergh ..... 434/419
434,717 A * 8/1890 Lofton ..... 248/163.1
482,771 A * 9/1892 Webster ..... 118/502
522,980 A * 7/1894 Fleming ..... 40/493
625,746 A * 5/1899 Colsten ..... 211/17
672,809 A * 4/1901 Russel ..... 38/102.21
684,097 A * 10/1901 Quigley ..... 118/500
739,852 A * 9/1903 Gerstbacher ..... 211/201
855,219 A * 5/1907 Anthony ..... 118/502
971,921 A * 10/1910 Nugent ..... 248/172
982,477 A * 1/1911 Cavanagh ..... 211/30
1,084,504 A * 1/1914 Thayer ..... 118/502
1,531,837 A * 3/1925 Boldin ..... 108/131
1,668,632 A * 5/1928 Darling ..... 211/47
1,843,834 A * 2/1932 Roberts ..... 38/102.21
2,036,459 A * 4/1936 Carter ..... 118/500
2,084,661 A * 6/1937 Wagstaff ..... 38/102.9
2,175,981 A * 10/1939 Vining ..... 211/28
2,177,169 A * 10/1939 Brown ..... 248/439
2,241,895 A * 5/1941 Walker et al. ..... 38/102.1
2,333,450 A * 11/1943 Staley ..... 248/188.1
2,388,180 A * 10/1945 Pulver, Jr. ..... 40/611.01
2,454,648 A * 11/1948 Green ..... 40/602

(Continued)

*Primary Examiner*—Sarah Purol
*Assistant Examiner*—James C. Dooley
(74) *Attorney, Agent, or Firm*—Weiner & Burt, P.C.; Irving M. Weiner; Pamela S. Burt

(57) ABSTRACT

Portable work stations which permit a one-step, touch-free finishing of all surfaces of doors, shutters, window sashes, cabinet doors, garage doors, spindles, and other workpieces. There are also provided trim measuring and cutting, and hinge mortising and prep racks, a leg assembly, a drying rack, and a trim board work station. All of these devices are provided by kits of components.

9 Claims, 5 Drawing Sheets

U.S. PATENT DOCUMENTS 2,749,071 A * 6/1956 Remstein ..... 248/172
2,849,745 A * 9/1958 Madsen ..... 15/268
2,903,312 A * 9/1959 Lawless ..... 108/62
2,955,632 A * 10/1960 Stone ..... 269/17
3,006,107 A * 10/1961 Tolegian ..... 248/449
3,071,204 A * 1/1963 Piltingsrud ..... 182/27
3,095,833 A * 7/1963 Peter ..... 108/3
3,227,105 A * 1/1966 Braude et al. ..... 108/13
3,625,504 A * 12/1971 Walker ..... 269/55
3,759,396 A * 9/1973 Best et al. ..... 211/47
3,899,164 A * 8/1975 Newman ..... 269/71
3,923,167 A * 12/1975 Blankenbeckler ..... 414/11
3,955,511 A * 5/1976 Bak ..... 108/137
4,026,219 A * 5/1977 Shupe et al. ..... 108/62
4,229,890 A * 10/1980 Dropinski ..... 38/102.1
4,235,005 A * 11/1980 James ..... 29/281.1
4,239,197 A * 12/1980 Olstad ..... 269/68
4,280,294 A * 7/1981 Eckberg, II ..... 40/606.15
4,383,680 A * 5/1983 Braceland ..... 269/43
4,392,601 A * 7/1983 Fujikawa et al. ..... 228/4.1
4,665,638 A * 5/1987 Morton ..... 38/102.1
4,877,109 A * 10/1989 Welch et al. ..... 182/182.4
4,880,194 A * 11/1989 Geise et al. ..... 248/166
D318,756 S * 8/1991 Schulle ..... D3/26
5,070,796 A * 12/1991 Marone et al. ..... 108/124
5,082,038 A * 1/1992 Teel ..... 144/286.5
D327,404 S * 6/1992 Le Cornec ..... D8/71
5,164,011 A * 11/1992 Ray ..... 118/500
5,226,250 A * 7/1993 Ulmer et al. ..... 38/102.9
5,502,929 A * 4/1996 Daniels ..... 52/69
5,660,637 A * 8/1997 Dodge ..... 118/500
5,694,881 A * 12/1997 Creech ..... 116/222
5,870,540 A * 2/1999 Wang et al. ..... 714/43
5,944,896 A * 8/1999 Landesman et al. ..... 118/500
6,090,204 A * 7/2000 Speed et al. ..... 118/500
6,338,758 B1 * 1/2002 Curran ..... 118/500
6,378,232 B1 * 4/2002 Creech ..... 40/606.15
6,520,092 B1 * 2/2003 Marshall et al. ..... 108/44
6,561,470 B1 * 5/2003 Gottfredson et al. ..... 248/201
D481,605 S * 11/2003 West ..... D8/72
6,702,130 B1 * 3/2004 Carlilse ..... 211/204
6,810,820 B1 * 11/2004 Okerlund et al. ..... 108/147
2004/0231570 A1 * 11/2004 Landa ..... 108/28

* cited by examiner

PORTABLE WORK STATIONS

The present patent application claims benifit of U.S. Patent Application Ser. No. 60/537,106 filed Jan. 16, 2004, which in turn is a continuation-in-part of U.S. patent application Ser. No. 10/719,492 filed on Nov. 21, 2003, the entire contents of which applications are incorporated herein by reference thereto.

The present invention relates generally to novel and unique portable work stations and devices which permit working on doors, shutters, window sashes, cabinet doors, garage doors, spindle racks, trim measuring and cutting, and hinge mortising and prep racks.

More particularly, the present invention relates to novel and unique devices which will allow doors and other workpieces to be painted on all sides in the horizontal position, a leg assembly therefor, a novel drying rack for such doors, spindle work station, mortising accessory, and a trim board work station.

BACKGROUND OF THE INVENTION

During the course of their work, professional painters typically paint or otherwise finish doors, spindles, and cabinet doors, of the type commonly found in houses and other buildings, either installed in the frame or leaning against the wall or other structure. Finishing a door in the vertical position, especially when using an airless or other type paint sprayer, can result in runs or sags in the finish due to gravity, overspraying onto adjacent surfaces, and an improper viewing angle for the painter.

Furthermore, because a typical construction site can range from very cluttered and dirty to well-maintained, but is rarely pristine, a door resting on or near the floor may have dirt or debris from the floor blown onto it by the sprayer as the finish is applied. If the door being finished is leaning against another structure, the finish must be applied to first one side, allowed to dry, turned, and the finish applied to the other side, a very time consuming process.

The prior, but not necessarily relevant, art is exemplified by Wood U.S. Pat. No. 5,090,648, Ray U.S. Pat. No. 5,164,011, and Speed et al. U.S. Pat. No. 6,090,204.

It is a desideratum of the present invention to avoid the animadversions of the current devices and techniques, and to provide a unique painter's portable jig, leg assembly, drying rack, a kit of components thereof, and other portable work stations.

The term "workpiece structure" as used herein means a workpiece itself, or workpieces themselves, or a structure for holding said workpiece or workpieces.

SUMMARY OF THE INVENTION

The present invention provides a portable work station, comprising, in combination: a frame structure releasably and temporarily supporting a workpiece structure; said frame structure having an open-sided upper portion formed by three upper members; said frame structure providing predetermined clearances between said frame structure and said workpiece structure; pivot means releasably connected to said frame structure for pivoting said workpiece structure within said frame structure; and stabilizing means releasably connected to said frame structure for stabilizing said workpiece structure within said frame structure when said workpiece structure is being worked upon.

The present invention also provides a novel and unique portable work station which permits easy access for working on doors, shutters, window sashes, cabinet doors, garage doors, spindle racks, trim measuring and cutting, and hinge mortising and prep racks, which permits working on and finishing all edges and sides of the workpiece at one time.

The present invention also provides a novel and unique mortising accessory for mortising a workpiece, such as conventional doors and cabinet doors, which mortising accessory can be used in conjunction with the portable work station mentioned hereinabove, or alternatively can be used separately as an independent mortising accessory.

The present invention also provides a novel and unique portable work station for use in the measurement and cutting of trim boards, wherein there is provided a built-in tape measure.

The present invention also provides a leg assembly for replacing a conventional sawhorse, comprising: a pair of vertical leg members; a pair of cross leg members affixed to said pair of vertical leg members; securement means at the top portions of said vertical leg members for releasably securing said vertical leg members to a portion of an external object to be supported by said leg assembly; and an adjustable angled support member releasably connectable at one end thereof to a predetermined portion of one of said vertical leg members, and releasably connectable at the other end thereof to a portion of said external object to be supported to maintain said leg assembly in orthogonal arrangement with said external object to be supported by said leg assembly.

The present invention also provides a drying rack for drying substantially flat elongated workpieces, comprising: an elongated L-shaped member which may be secured to an external support structure; said L-shaped member having an upper edge which is provided with a series of cutouts to accommodate at least one member protruding from said substantially flat elongated workpiece; and a cross member releasably securable to two or more of said substantially flat elongated workpieces to hold said workpieces in a substantially vertical position while said substantially flat elongated workpieces are drying.

It is a primary object of the present invention to provide a painter's portable jig which allows a door to be finished in a flat, horizontal position on both sides without the necessity of removing the door from the jig.

A further object of the present invention is to provide a novel and unique portable work station for working on doors, shutters, window sashes, cabinet doors, garage doors, spindle racks, trim measuring and cutting, and hinge mortising and prep racks, which permits the working on and finishing of all edges and sides of the workpiece at one time.

Another object of the present invention is to provide a mortising accessory for facilitating the mortising of conventional doors and cabinet doors, which mortising accessory can be used in conjunction with the portable work stations mentioned hereinabove or alternatively, can be used separately and independently of such work stations.

Yet another object of the present invention is to provide a novel portable device for working on various workpieces, such as trim boards, which has a built-in tape measure and which allows for the easy and proper cutting of the workpiece.

Another object of the invention is to provide a unique drying rack which permits a plurality of doors to be dried in a vertical orientation.

A further object of the invention is to provide a unique leg assembly which can be used with the portable jig to replace conventional saw horses.

Yet a further object of the invention is to provide a painter's portable jig as described above, wherein such jig may be transported and/or stored in an unassembled, convenient arrangement.

Another object of the invention is to provide a painter's portable jig as described above, wherein such jig is adjustable from approximately 30" to 8'6".

A further object of the invention is to provide a kit of components for said portable jig, leg assembly, and/or drying rack.

These and other objects and advantages of the present invention will become readily apparent to those persons skilled in this particular area of technology and to others upon reading the following specification and the accompanying drawings.

DETAILED DESCRIPTION OF THE INVENTION

Figure 1:
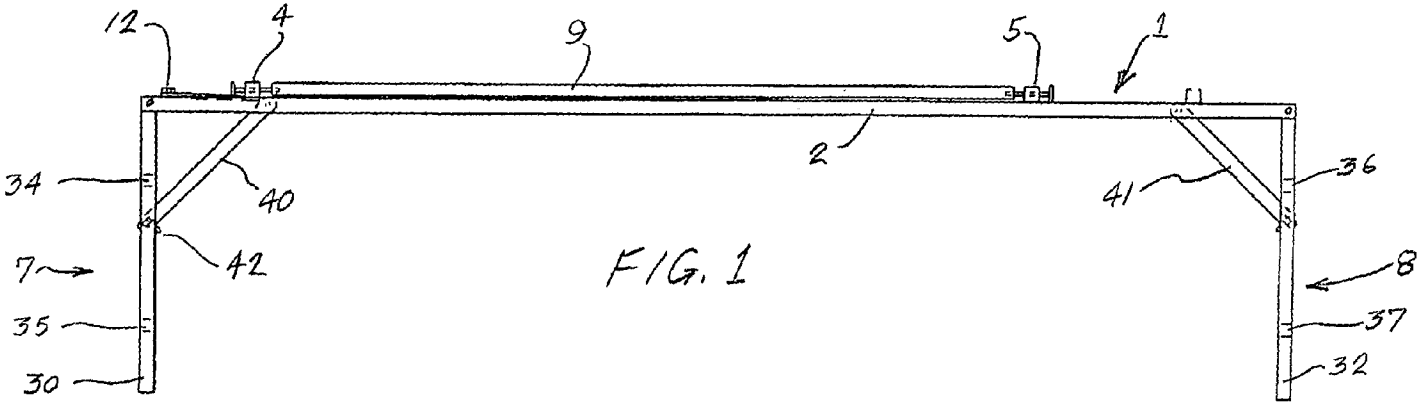
FIG. 1 illustrates a vertical elevational view of a door mounted on a painter's portable jig in accordance with a first embodiment of the present invention.

A work station in the form of a painter's portable jig 1 according to the present invention is described in connection with FIGS. 1 and 2.

The main components of the jig 1 comprise a pair of elongated upper or side members 2 and 3, a pair of upper or cross members 4 and 5, and an adjustable squaring mechanism 6 for maintaining the assembled components 2, 3, 4 and 5 in a perpendicular arrangement.

The disassembled jig components 2, 3, 4, 5 and 6 may be stacked in a convenient arrangement for transportation or storage, and held together with eye bolts and wing nuts (not shown).

Figure 2:
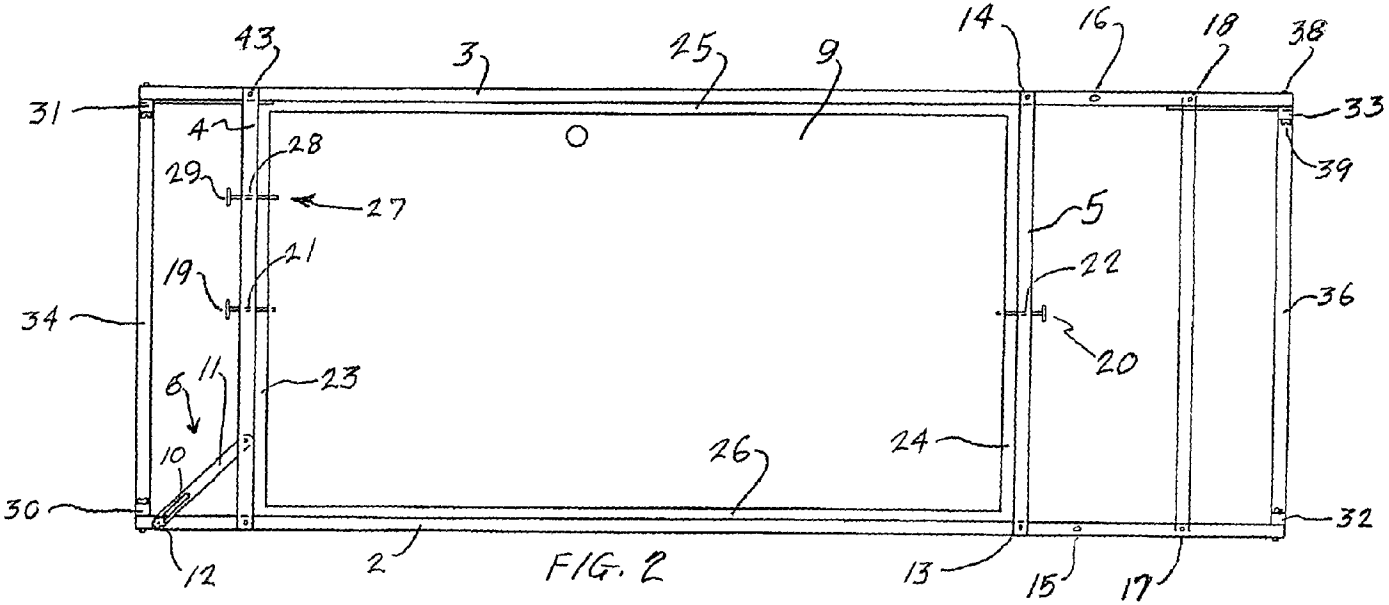
FIG. 2 depicts a top plan view of the apparatus shown in FIG. 1.

FIGS. 1 and 2 show the assembled jig 1 in its operative condition and supported on the novel leg assemblies 7 and 8 which preferably, but not necessarily, replace conventional saw horses. Before a workpiece structure such as a door or other suitable workpiece 9 is placed in the jig 1, the side members 2 and 3 and the cross members 4 and 5 are arranged in a perpendicular arrangement, and maintained in such perpendicular arrangement by the adjustable squaring mechanism 6 having a slot 10 in its main member 11 and secured by a knob and threaded bolt device 12. The adjustable squaring mechanism 6 is positioned near one corner of the jig 1 where one side member 2 meets one cross member 4.

The side members 2 and 3 are pre-drilled with various holes 13, 14, 15, 16, 17 and 18 to accommodate different sizes of doors 9. Preferably, but not necessarily, there are provided: a pair of pre-drilled holes 13 and 14 to accommodate a door 9 that is 6' 8" long; a pair of pre-drilled holes 15 and 16 to accommodate a door 9 that is 7' 0" long; and a pair of pre-drilled holes 17 and 18 to accommodate a door 9 that is 8' 0" long.

The door 9 is placed in the jig 1 and pivotally mounted thereon by two centrally-located pivot mechanisms 19 and 20, such as knob-handled lag screws, which pass through a pre-drilled hole 21 or 22 in their associated cross members 4 or 5, and then through the space 23 or 24 between the cross members 4 or 5 and the door 9, and then into the door 9 itself.

The jig 1 provides predetermined spaces or clearances 23, 24, 25 and 26 between the door 9 and the components of the jig 1. In this manner, the door 9 may be pivoted or rotated from one surface to another without interference with the cross members 4 and 5 or the side members 2 and 3.

A door stabilizing mechanism 27 is provided to hold the door 9 in a horizontal arrangement when one of its major sides is being finished or painted. Preferably, but not necessarily, the door stabilizing mechanism 27 comprises a pre-drilled hole 28 at a predetermined location in a cross member 4, cooperating with a knob-handled lag screw 29 which passes therethrough into the door 9. This door stabilizer mechanism 27 holds the door 9 in the horizontal position while a major surface of the door 9 is being painted. When it is desired to rotate or flip the door 9 so that the opposite major surface can be painted, or the edges of the door 9 can be painted, the door stabilizing mechanism 27 is temporarily removed to permit pivoting of the door 9.

The cross members 4 and 5 can be releasably assembled to the side members 2 and 3 by any suitable releasable connecting mechanisms 43, such as pins, D-rings, bolts, etc.

The portable jig 1 as described above can be supported, if desired, on conventional saw horses, and disassembled for transportation and/or storage in a convenient package. However, a preferable arrangement involves the unique disassemblable leg assemblies 7 and 8 described hereinbelow.

Preferably, but not necessarily, each leg assembly 7 or 8 comprises two vertical members 30, 31 or 32, 33 welded orthogonally to two cross leg members 34, 35 or 36, 37, respectively. The top portions of the vertical leg members 30, 31, 32 and 33 may be releasably secured to the end of the jig side members 2 and 3 by suitable bolts 38 and wing nuts 39. To maintain the leg assemblies 7 and 8 in orthogonal arrangement with the jig side members 2 and 3, there is provided a pair of angled support members 40 and 41 for securement to one of the jig side members 3. Such angled support members 40 and 41 are releasably secured to the jig side member 3 and a vertical leg member 31 or 33, respectively, by releasable D-pins 42.

Although only two angled support members 40 and 41 are shown in the drawings, there can, of course, be three or four such members used if desired.

It should be appreciated that upon disassembly, the leg assemblies 7 and 8 and the components of the portable jig 1 can all be disassembled conveniently for storage and/or transportation, and assembled on site with a minimum of effort.

It will be appreciated that after the doors 9 have been painted or finished using the apparatus shown in FIGS. 1 and 2, it is desirable and necessary to arrange for the painted doors 9 to dry properly. For this purpose, the novel and unique drying rack 50 depicted in FIG. 3 is utilized in accordance with a second embodiment of the invention.

The drying rack 50 includes an elongated L-shaped member 51 which is secured to a common saw horse 52 with screws 53. Such L-shaped member 51 may preferably, but not necessarily, comprise a 12 inch by 12 inch by 48 inches long by ⅛ inch thick angled aluminum member. The upper edge 63 of the L-shaped member 51 is provided with a series of cutouts 54 to accommodate T-handle screws or lag bolts 55 and 56. Such T-handle screws or lag bolts 55 or 56 are positioned centrally in the door edge where the central pivot mechanisms 19 and 20 shown in FIGS. 1 and 2 were placed.

Figure 3:
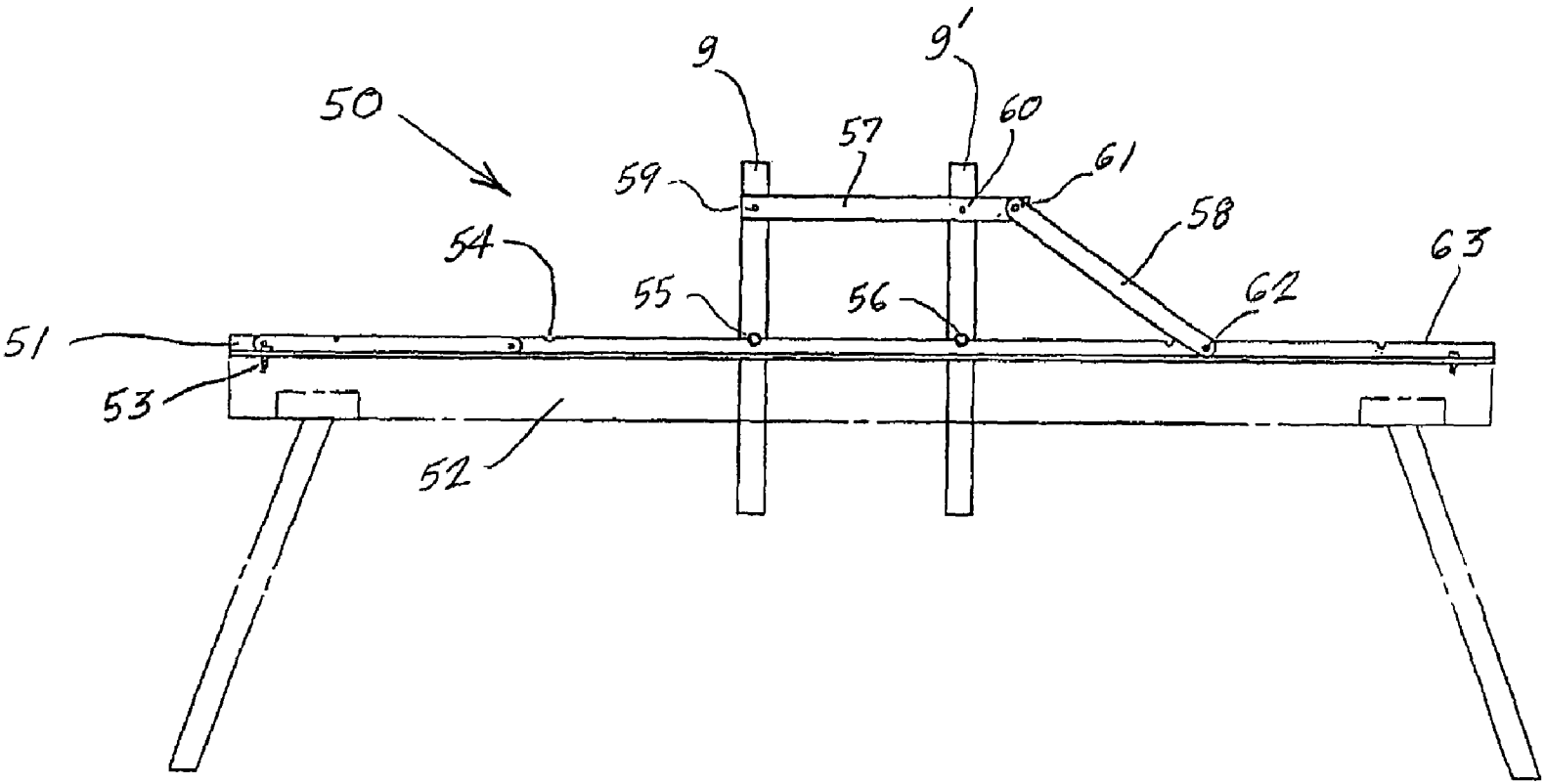
FIG. 3 illustrates a vertical elevational view of two doors mounted in the novel drying rack in accordance with a second embodiment of the present invention.

FIG. 3 shows two doors 9 and $9^1$ being supported in the drying rack 50. Remote from the viewer of FIG. 3, on the opposite side of the doors 9 and $9^1$, is another portion of the drying rack 50 similar to that described hereinabove.

The portion of the drying rack 50 shown in FIG. 3 is provided with a cross member 57 to hold the doors 9 and $9^1$ in vertical position while drying, with such cross member 57 being connected to the L-shaped member 51 by a support bracket 58. Preferably, but not necessarily, such support bracket 58 may comprise an aluminum or mild steel member which is 1/16 of an inch by ¾ of an inch by 11 inches.

Suitable fastening members 59, 60, 61 and 62 are employed for releasably interconnecting the cross member 57 to the doors 9 and $9^1$, and for pivotally interconnecting the support bracket 58 to the L-shaped member 51 and the cross member 57. Only one such cross member 57 and support bracket 58 is necessary for holding the drying doors 9 and $9^1$ in position while drying.

Although FIG. 3 shows only two doors 9 and $9^1$ being held while drying, the drying rack 50 is provided with sufficient cutouts 54 and space to accommodate three or more doors.

The present invention also provides a novel kit of components, taken singly or in combination, for all the workpiece stations, the painter's portable jig 1, the novel leg assemblies 7 and 8 therefor, and the novel drying rack 50 disclosed herein.

A third embodiment of the present invention will now be described with reference to FIG. 4.

Figure 4:
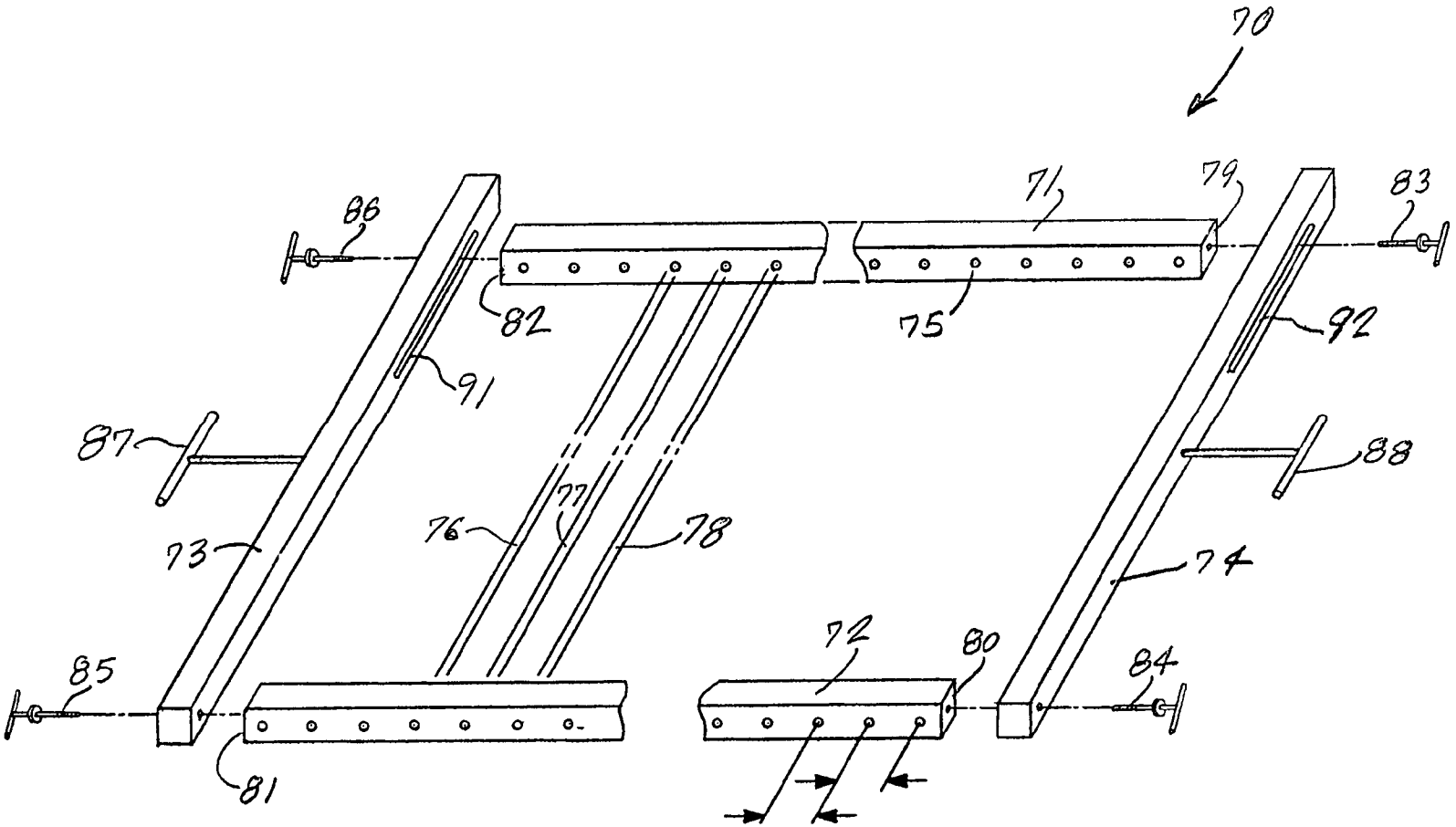
FIG. 4. is a perspective view of the top portion of a third embodiment of the present invention which can be used for working on spindles and other workpieces.

The embodiment shown in FIG. 4 is particularly useful for working on spindle workpieces. The workpiece structure 70 depicted in FIG. 4 includes a pair of side members 71 and 72 and a pair of end members 63 and 74. Preferably, but not necessarily, the side members 71 and 72 may comprise a 65-inch length of 1/14 aluminum tubing have 9/16 of an inch holes 75 therein. The holes 75 are used to hold the ends of spindle workpieces which are shown diagrammatically by the lines 76, 77 and 78. The side members 71 and 72 are provided with inserts 79, 80, 81 and 82 for threadably receiving bolts 83, 84, 85, and 86, respectively.

Figure 5:
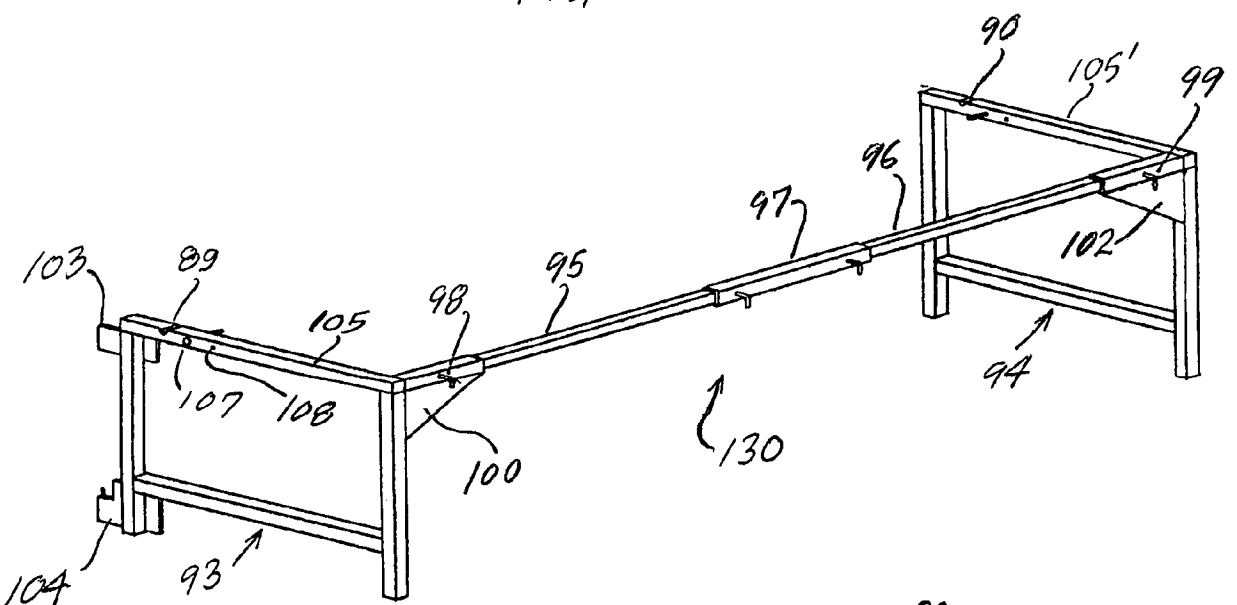
FIG. 5 is a perspective view of a fourth embodiment in the form of an understructure which can be used to support the structure shown in FIG. 4, or alternately to support a door as shown in FIGS. 1 and 2.

The end members 73 and 74 may preferably, but not necessarily, be constructed from aluminum tubing and include handles 87 and 88 to lay in the pivot slots 89 and 90 in members 105 and 105', respectively, of the frame structure or understructure 130 shown in FIG. 5. Each end member 73 and 74 is provided with an adjustable slot 91 and 92 for accommodating different lengths of spindles or other workpieces. Each end member 73 or 74 is provided with bolts 83–86 which pass through the end member 73 or 74 and into the inserts 74–82 at the ends of the side members 72 and 72.

A frame structure 130 which serves as an alternate to the jig 1, or as the understructure of the workpiece structure 70, is shown in FIG. 5. This frame structure 130 includes a pair of leg assemblies 93 and 94 which are interconnected by an upper member, which upper member includes a pair of elongated members 95 and 96 which are adjustably interconnected by a central member 97. The connection arrangement also includes a pair of locking handles 98 and 99 and squaring members 100 and 102.

An optional mortising accessory can also be provided if desired. The two main components 103 and 104 of the mortising accessory are shown secured to the left leg assembly 93 in FIG. 5.

Figure 6:
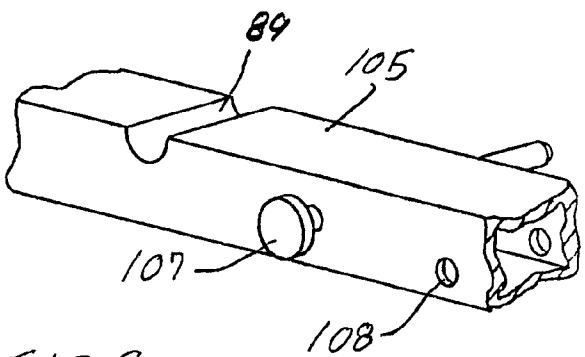
FIG. 6 is an enlarged view of the upper left-hand portion of FIG. 5.
Figure 10:
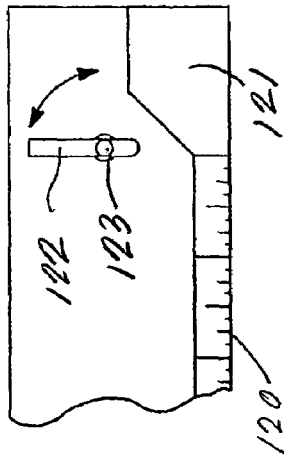
FIG. 10 is an exploded partial view of the right end portion shown in FIG. 9.

The exploded view in FIG. 6 shows a portion of the member 105 having a ⅝-inch slot 89 disposed therein, a turn-in lock pin 107, and a hole 108 for working on cabinet doors or full-sized conventional doors.

A fifth embodiment of the invention is shown in FIGS. 7–10. The fifth embodiment comprises a portable work station 110 which can be used for measuring and cutting a plethora of workpieces, but is particularly suitable for measuring and cutting trim boards.

Figure 7:
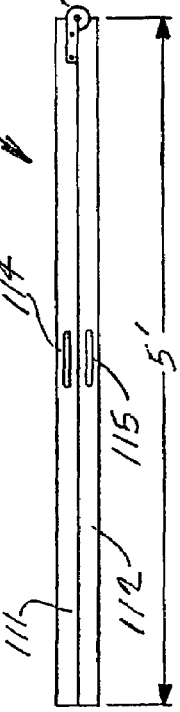
FIG. 7 is a view of a fifth embodiment of the present invention shown in its folded, storage, or carrying position, and which can be used for the measuring and cutting of trim board and other suitable workpieces.

As shown in FIG. 7, the work station 110 comprises a pair of main members 111 and 112 which are interconnected by a knife hinge 113. The main members 111 and 112 are provided with handles 114 and 115 to facilitate the portability and carrying thereof. Preferably, but not necessarily, each main member 111 and 112 is approximately five feet in length.

Figure 8:
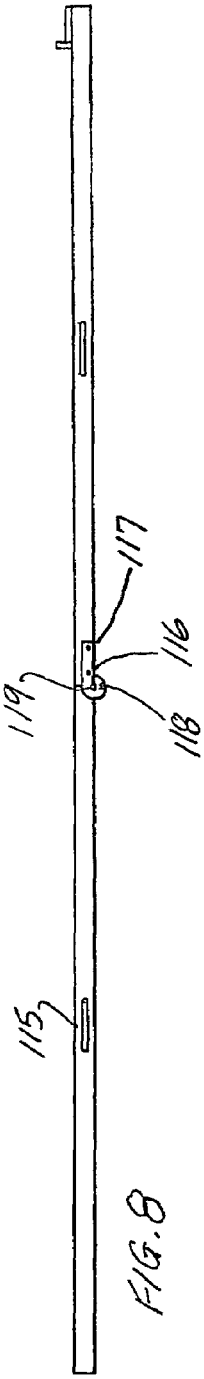
FIG. 8 is a side elevational view of the embodiment shown in FIG. 7, but in FIG. 8 the device is unfolded into its operating working configuration.
Figure 9:
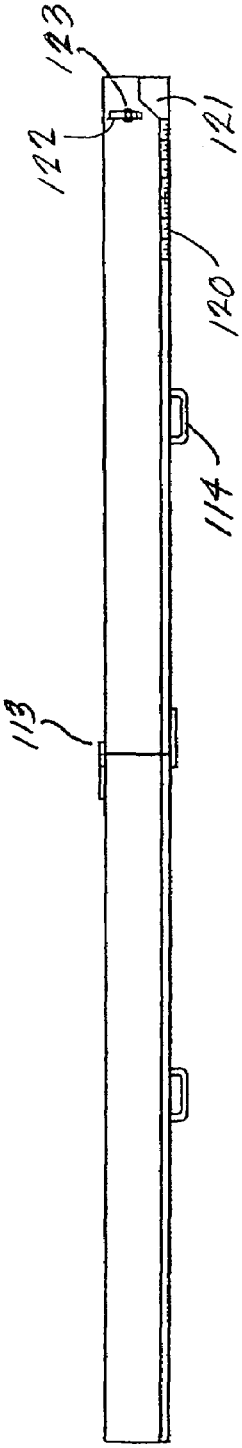
FIG. 9 is a top plan view of the FIG. 8 structure.

FIGS. 8 and 9 show the work station 110 unfolded in its full operating condition. Preferably, but not necessarily, each main member 111 and 112 may be fabricated from 2-inch by 6-inch aluminum U-channel.

The knife hinge structure 113 includes bolts 116 and 117, a position lock pin 118 and an angle pin 119.

The work station 110 includes a built-in tape measure 120 which extends from a 45 degree angle stop 121. A work piece, such as a piece of trim board (not shown), may be positioned against the 45 degree angle stop 121. It should be mentioned at this point that it is difficult and unwieldy to get a measurement of the short side of a trim board from the angled cut. This problem is solved by the fact that the built-in tape measure 120 of this embodiment gives a measurement commencing from the short side of the angle, without having to hold a conventional tape measure on it. In this manner, the measurement of the short side of a workpiece or trim board is easily ascertained with the built-in tape measure 120 of this device 110.

This device also includes a slot with an adjustable trim stop for accommodating various widths of trim board, and to enable the square cutting of such a trim board.

The foregoing description of some preferred embodiments of the present invention has been presented for the purpose of description and illustration only, and not for limitation. It is not intended to be exhaustive or to limit the invention to the precise form and components disclosed. Many modification and variations are possible in light of the above description, and will occur to those persons skilled in this area of technology and to others after having read the present patent application.

The invention claimed is:

1. A portable work station, comprising, in combination:

a frame structure releasably and temporarily supporting a workpiece structure;

said frame structure having an open-sided upper portion formed by three substantially horizontal upper members;

said three substantially horizontal upper members comprise a pair of upper substantially parallel cross members which are releasably connected to a third upper member disposed substantially perpendicular to said upper substantially parallel cross members;

said frame structure includes adjustment means which permit said three upper substantially horizontal members to be laterally adjusted to accommodate various sizes of said workpiece structure;

said frame structure providing predetermined clearances between said frame structure and said workpiece structure;

pivot means releasably connected to said frame structure for independently pivoting said workpiece structure within said frame structure about a substantially horizontal axis; and stabilizing means releasably connected to said frame structure for stabilizing said workpiece structure within said frame structure when said workpiece structure is being worked upon.

2. A portable work station according to claim 1, including:

an adjustable squaring mechanism for maintaining said frame structure in an orthogonal arrangement.

3. A portable work station according to claim 1, including:

a pair of disassemblable leg assemblies for releasably supporting said frame structure; and a pair of angled support mechanisms connecting said leg assemblies to said frame structure to maintain said leg assemblies in orthogonal arrangement with said frame structure.

4. A portable work station according to claim 2, including:

a pair of disassemblable leg assemblies for releasably supporting said frame structure; and a pair of angled support mechanisms connecting said leg assemblies to said frame structure to maintain said leg assemblies in orthogonal arrangement with said frame structure.

5. A leg assembly for replacing a conventional sawhorse, comprising:

a pair of vertical leg members;

a pair of cross leg members unitary with said pair of vertical leg members;

securement means at the topmost ends of said vertical leg members for releasably securing said vertical leg members to a portion of an external object to be supported by said leg assembly; and an adjustable angled support member releasably connectable at one end thereof to a predetermined portion of one of said vertical leg members, and relcasably connectable at the other end thereof to a portion of said external object to be supported to maintain said leg assembly in a orthogonal arrangement wit said external object to be supported by said leg assembly said external object to be supported by said leg assembly comprises a portable work station which includes:

a frame structure releasably and temporarily supporting a workpiece structure;

said frame structure have an open-sided upper portion fanned by three substantially horizontal upper members;

said three substantially horizontal upper members comprise a pair of upper substantially parallel cross members which are releasably connected to a third upper member disposed substantially perpendicular to said upper substantially parallel cross members;

said frame structure includes adj ustinent means which pennits said three upper substantially horizontal members to be adjustably moved to accommodate various sizes of said workpiece structure;

said frame structure provides predetermined clearances between said frame structure and said workpiece structure;

pivot means releasably connected to said frame structure for pivoting said workpiece structure within said frame structure about a substantially horizontal axis; and stabilizing means releasably connected to said frame structure for stabilizing said workpiece structure within said frame structure when said workpiece structure is being worked an; and said adjustable angled support member is releasably connected between said one of said vertical leg members and one of said three substantially horizontal upper members of said portable work station.

6. A leg assembly according to claim 5, wherein:

said external object to be supported by said leg assembly comprises a portable jig having side members; and said angled support member is releasably connected between said one of said vertical leg members and one of said side members of said portable jig.

7. A leg assembly according to claim 5, wherein:

said leg assembly is disassembled for storage and transportation, and assembled at a work site with a minimum of effort.

8. A leg assembly according to claim 6, wherein:

said leg assembly is disassembled for storage and transportation, and assembled at a work site wit a minimum of effort.

9. A leg assembly according to claim 5, wherein:

said external object to be supported by said leg assembly comprises a portable work station which includes:

a frame structure releasably and temporarily supporting a workpiece structure;

said frame structure having an open-sided upper portion formed by three upper members;

said frame structure providing predetennined clearances between said frame structure and said workpiece structure;

pivot means releasably connected to said frame structure for pivoting said workpiece structure within said frame structure; and stabilizing means releasably connected to said frame structure for stabilizing said workpiece structure within said frame structure when said workpiece structure is being worked upon; and said adjustable angled support member is releasably connected between said one of said vertical leg members and one of said three upper members of said portable work station.

* * * * *